US009478200B2

(12) United States Patent
Maezawa

(10) Patent No.: US 9,478,200 B2
(45) Date of Patent: Oct. 25, 2016

(54) MAPPING ESTIMATION APPARATUS

(71) Applicant: YAMAHA CORPORATION, Hamamatsu-shi, Shizuoka (JP)

(72) Inventor: Akira Maezawa, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/871,047

(22) Filed: Sep. 30, 2015

(65) Prior Publication Data

US 2016/0098977 A1 Apr. 7, 2016

(30) Foreign Application Priority Data

Oct. 1, 2014 (JP) ..... 2014-203353

(51) Int. Cl.
*G10H 7/00* (2006.01)
*G10G 1/00* (2006.01)

(52) U.S. Cl.
CPC ..... *G10G 1/00* (2013.01); *G10H 2220/015* (2013.01)

(58) Field of Classification Search
CPC ..... G10G 1/00; G10H 2220/015
USPC ..... 84/602
See application file for complete search history.

(56) References Cited

U.S. PATENT DOCUMENTS 6,084,168 A * 7/2000 Sitrick ..... G09B 15/023 84/477 R
9,224,129 B2 * 12/2015 Sitrick ..... G06Q 10/101
2006/0117935 A1 * 6/2006 Sitrick ..... G09B 15/023 84/477 R
2014/0260912 A1 * 9/2014 Maezawa ..... G10H 1/40 84/612
2015/0277731 A1 * 10/2015 Uemura ..... G10G 1/00 715/765
2015/0279342 A1 * 10/2015 Uemura ..... G10G 1/00 84/483.2

FOREIGN PATENT DOCUMENTS

JP 2009216769 A 9/2009
JP 2009223078 A 10/2009
JP 4751490 B1 8/2011
WO 2012090279 A1 7/2012

* cited by examiner

*Primary Examiner* — Jeffrey Donels
(74) *Attorney, Agent, or Firm* — Rossi, Kimms & McDowell LLP

(57) ABSTRACT

A mapping estimation apparatus includes a mapping adjuster. The mapping adjuster estimates mappings which correlate a plurality of subset data items with respective parts of universal set data including union of the plurality of subset data items based on the plurality of subset data items and the universal set data. The mapping adjuster estimates a mode of selecting a plurality of codomain data items from the universal set data and modes of mappings applied to the plurality of subset data items so as to have a maximum probability that data items obtained by selecting a plurality of codomain data items of which a subset of union is the universal set data from the universal set data and applying the mappings to the plurality of subset data items as domains will be respectively the plurality of codomain data items.

4 Claims, 7 Drawing Sheets

FIG.2A
FIG.2B
FIG.2C
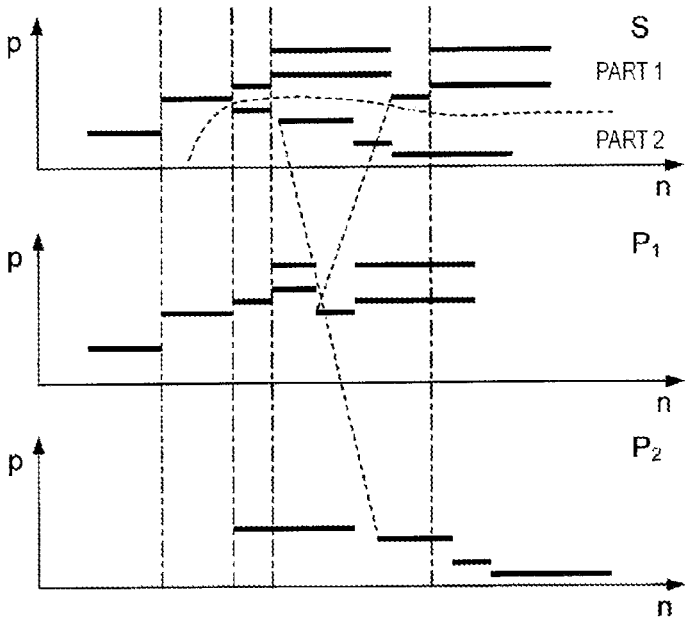
FIG.3
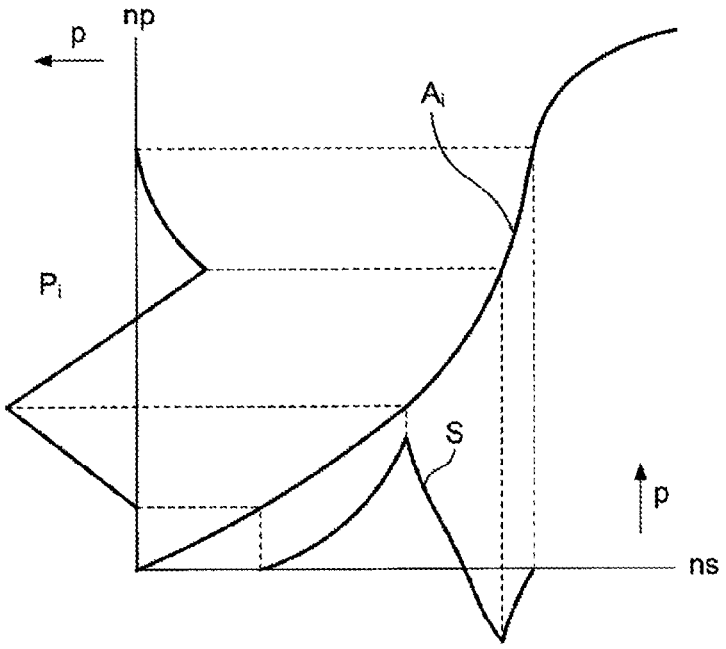

MAPPING ESTIMATION APPARATUS

CROSS REFERENCE TO RELATED APPLICATION(S)

This application is based upon and claims the benefit of priority of Japanese Patent Application No. 2014-203353 filed on Oct. 1, 2014, the contents of which are incorporated herein by reference in its entirety.

BACKGROUND OF THE INVENTION

1. Field of the Invention

The present invention relates to a mapping estimation apparatus that estimates mappings of subset data items to universal set data, such as mappings of part scores to a full score.

2. Description of the Related Art

In a musical ensemble, a conductor typically conducts while seeing a full score, and performers of the respective parts play their musical instruments while seeing their part scores created for the respective parts. When the ensemble rehearses, it is necessary for the conductor to indicate play positions to the performers of respective parts. As a method of conducting the play positions in this case, there is a method using markers called rehearsal marks dotted in the full score and the respective part scores. That is, the conductor indicates the play positions to the performers of the respective parts in, for example, the condition that "from before the 27th bar of rehearsal mark A". When bar numbers are written in the musical score, the play positions may be indicated by the bar numbers. WO 2012/090279 A1 as Patent Document 1 discloses a technology in which in a system including a master device that displays a full score and slave devices that display part scores, the page-turning of the part scores in the slave devices is synchronized with the page-turning of the full score in the master device. In the technology disclosed in WO 2012/090279 A1, in order to synchronize page-turning, information indicating a page after the page-turning is sent from the master device to the slave devices. According to this technology, it is possible to display the page including the play positions on the slave devices.

Patent Document 1: WO 2012/090279 A1
Patent Document 2: JP-A-2009-216769
Patent Document 3: JP-A-2009-223078

SUMMARY OF THE INVENTION

However, when the play positions are indicated using the rehearsal marks, it is necessary for the performers of the respective parts to find a page in which the indicated rehearsal mark is written by turning the page of the part score and to find the play position by counting the number of bars indicated by the rehearsal mark of this page. The bar number is written only on the front of manuscript paper. Accordingly, when the bar number in the middle of the manuscript paper is indicated, the performers of the respective parts need to put forth considerable effort to find the bar having the indicated bar number. In the technology of WO 2012/090279 A1, it is possible to synchronize the page-turning of the musical scores in the master device and the slave devices. However, even though this technology is used, it is difficult for a user of the slave device to find a position, which corresponds to an arbitrary position on the full score indicated by a user of the master device, from the part score. As mentioned above, in the present state, there is a problem that the performers of the respective parts need to make an effort to find the play positions indicated by the conductor. Although it has been described that the full score and the part scores are used, such problems may also be caused in a case where information other than the musical score is used. For example, when individual users use a plurality of subset data items (corresponding to a plurality of part scores which is subsets of notes) which are time-series data items, and universal set data (corresponding to the full score) which includes the union of the subset data items, the user who uses the universal set data wants to notify the users who use the plurality of subset data items of a specific time position in the universal set data in some cases. In this case, if the universal set data and the respective subset data items do not include information corresponding to a time axis, even though the specific time position of the universal set data is designated, it is difficult to find the elements (notes, in the example of the musical score) of the sets positioned in the time positions of the subset data items.

The present invention has been made in view of the aforementioned circumstances, and it is a non-limited object of the present invention to provide technical means capable of sharing positions (time positions in the aforementioned example) of elements of sets within the respective set data items between universal set data and a plurality of subset data items.

An aspect of the present invention provides a mapping estimation apparatus including a mapping adjuster. The mapping adjuster reads out score data indicating musical score of musical performance and a plurality of part score data items indicating a plurality of subset data items of the score data from a storage unit, and estimates mappings which correlate the plurality of part score data items with respective parts of the score data. The mapping adjuster estimates a mode of selecting a plurality of codomain data items from the score data and modes of mappings applied to the plurality of part score data items so as to have a maximum probability that data items obtained by selecting a plurality of codomain data items of which a subset of union is the score data from the score data and applying the mappings to the plurality of part score data items as domains will be respectively the plurality of codomain data items.

Another aspect of the present invention provides a mapping estimation apparatus including a mapping adjuster. The mapping adjuster reads out a plurality of part score data items indicating musical scores of a plurality of musical performance parts and full score data including union of the part score data items from a storage unit, and estimates mappings which correlate the plurality of part score data items with respective parts of the full score data. The mapping adjuster estimates a mode of selecting a plurality of codomain data items from the full score data and modes of mappings applied to the plurality of part score data items so as to have a maximum probability that data items obtained by selecting a plurality of codomain data items of which a subset of union is the full score data from the full score data and applying the mappings to the plurality of part score data items as domains will be respectively the plurality of codomain data items.

Still another aspect of the present invention provides a mapping estimation apparatus including a mapping adjuster. The mapping adjuster that estimates mappings which correlate a plurality of subset data items with respective parts of universal set data including union of the plurality of subset data items based on the plurality of subset data items and the universal set data. The mapping adjuster estimates a mode of selecting a plurality of codomain data items from the universal set data and modes of mappings applied to the plurality of subset data items so as to have a maximum probability that data items obtained by selecting a plurality of codomain data items of which a subset of union is the universal set data from the universal set data and applying the mappings to the plurality of subset data items as domains will be respectively the plurality of codomain data items.

Still another aspect of the present invention provides a mapping estimation method that includes reading out score data indicating musical score of musical performance and a plurality of part score data items indicating a plurality of subset data items of the score data from a storage unit; and estimating mappings which correlate the plurality of part score data items with respective parts of the score data. Estimating of the mappings includes estimating a mode of selecting a plurality of codomain data items from the score data and modes of mappings applied to the plurality of part score data items so as to have a maximum probability that data items obtained by selecting a plurality of codomain data items of which a subset of union is the score data from the score data and applying the mappings to the plurality of part score data items as domains will be respectively the plurality of codomain data items.

According to one or some aspects of the present invention, it may be possible to estimate mappings having the maximum probability that data items obtained by applying mappings which use a plurality of subset data items as domains and a plurality of codomain data items of which a subset of the union is the universal set data as codomains to the plurality of subset data items will be respectively the plurality of codomain data items. Accordingly, it is possible to share positions of elements of sets within the respective set data items between the universal set data and the plurality of subset data items based on the mappings.

BRIEF DESCRIPTION OF THE DRAWINGS

FIGS. 2A, 2B and 2C are diagrams showing an example of the correlation of part score data items with full score data in the present embodiment.

FIG. 3 is a diagram showing an example of the processing content of TDW used in the present embodiment.

DETAILED DESCRIPTION OF THE EXEMPLARY EMBODIMENTS

Hereinafter, embodiments of the present invention will be described with reference to the drawings.

First Embodiment

Figure 1:
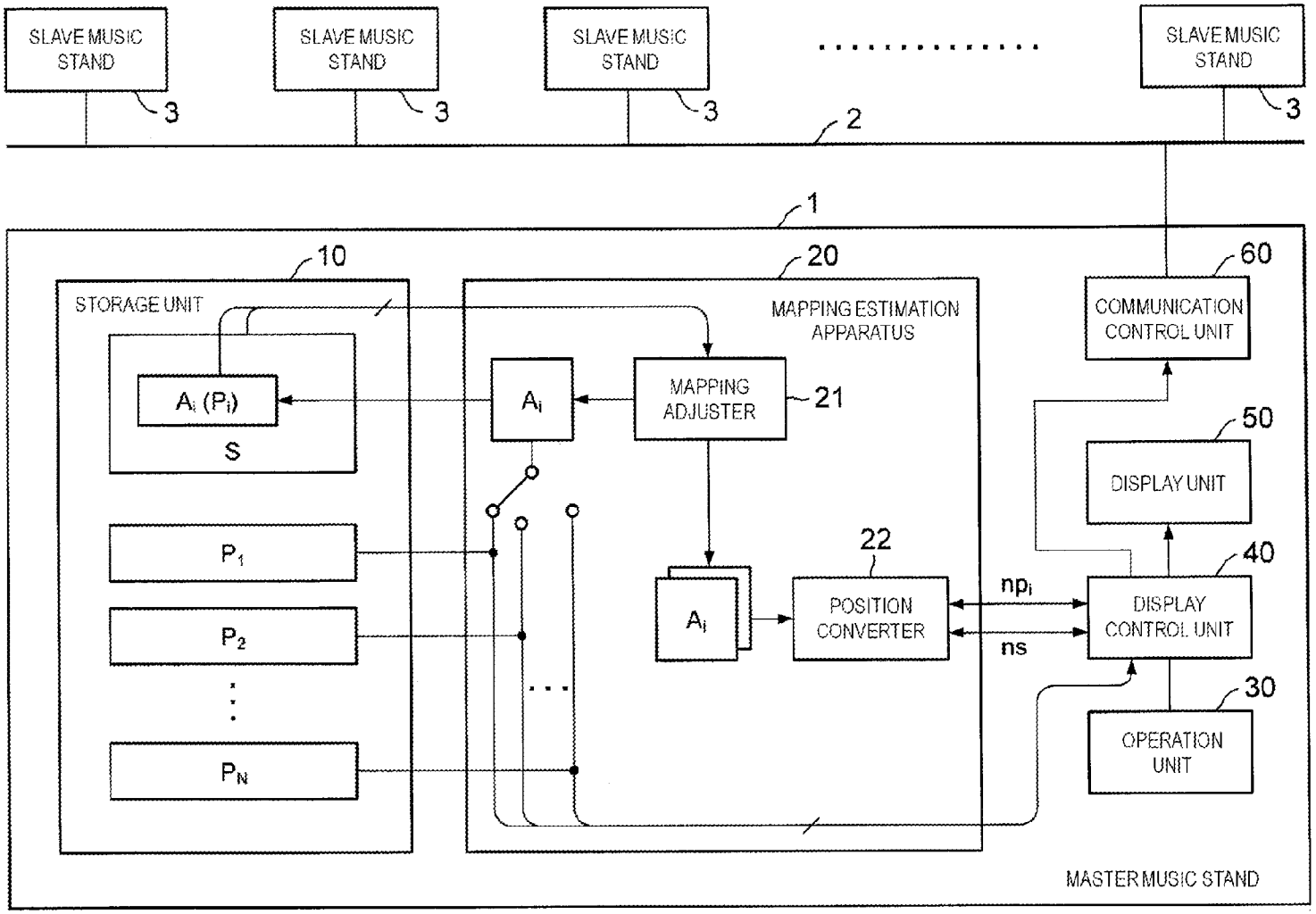
FIG. 1 is a block diagram showing the configuration of a musical score display system using a mapping estimation apparatus which is a first embodiment of the present invention.

FIG. 1 is a block diagram showing a configuration example of a musical score display system using a mapping estimation apparatus 20 which is a first embodiment of the present invention. The musical score display system includes a master music stand 1, and a plurality of slave music stands 3 connected to the master music stand 1 via a network 2. Here, the master music stand 1 is used by, for example, a conductor of an orchestra, and the slave music stands 3 are used by, for example, performers who play the respective parts of an ensemble that contains a plurality of parts.

The master music stand 1 includes a storage unit 10, the mapping estimation apparatus 20 according to the present embodiment, an operation unit 30, a display control unit 40, a display unit 50, and a communication control unit 60. In the illustrated example, the storage unit 10 stores full score data S, and a plurality of part score data items $P_i$ (i=1 to N). Here, the part score data items $P_i$ (i=1 to N) are time-series subset data items indicating the respective notes of the respective parts constituting the ensemble. The full score data S is time-series universal set data indicating the respective notes of the full score which is the union of subsets indicated by the part score data items $P_i$ (i=1 to N). The full score data S and the part score data items $P_i$ (i=1 to N) may be data items generated by recognizing the pitch, length, and the occurrence order of the notes of the full score or the part scores using means such as optical music recognition (OMR), or may be musical score data items in, for example, standard MIDI file (SMAF) format.

The display control unit 40 displays images of the full score indicated by the full score data S and images of the part scores indicated by the part score data items $P_i$ (i=1 to N) within the storage unit 10 on the display unit 50 according to the operation of the operation unit 30. The display control unit 40 transmits the part score data items $P_i$ (i=1 to N) to the plurality of slave music stands 3 through the communication control unit 60, and displays the images of the part scores indicated by the part score data items $P_i$ (i=1 to N) in the respective slave music stands 3.

In the present embodiment, for example, in a state in which the full score is displayed on the display unit 50, when an arbitrary time position on the full score is indicated by the operation of the operation unit 30, the display control unit 40 obtains time positions on the respective musical scores corresponding to the indicated time position on the full score by means of the mapping estimation apparatus 20. The display control unit 40 transmits position data items indicating the time positions on the part scores to the slave music stands 3 that display the respective part scores by means of the communication control unit 60. The slave music stands 3 that have received the position data items display positions indicated by the position data items on the part scores. In the present embodiment, for example, when the performer who uses the slave music stand 3 indicates an arbitrary time position on the part score displayed on the slave music stand 3, the slave music stand 3 transmits position data indicating the indicated time position on the part score to the master score stand 1. In this case, in the master music stand 1, when the communication control unit 60 receives the position data, the display control unit 40 obtains a time position on the full score corresponding to the indicated time position on the part score indicated by the position data by means of the mapping estimation apparatus 20, and displays the time position on the full score so as to be superposed on the full score displayed on the display unit 50. The display control unit 40 of the master music stand 1 may display the part score data on the display unit 50 based on the position data. In this case, the display control unit 40 may switch displays of the score data and the part score data while maintaining the position data. The display control unit 40 may divide the score data into respective parts responsible for the part score data items.

As stated above, in the present embodiment, a function or method for performing mutual conversion between the time position on the full score and the time position on the part score is included in the mapping estimation apparatus 20, and the display control unit 40 achieves the sharing (synchronization) of a time axis between the full score and the plurality of part scores by using the mapping estimation apparatus 20.

As shown in FIG. 1, the mapping estimation apparatus 20 includes a mapping adjuster 21, and a position converter 22. The mapping adjuster 21 includes a function of estimating mappings $A_i$ (i=1 to N) having the maximum probability that the union of data items $A_i(P_i)$ (i=1 to N) obtained by applying the mappings $A_i$ (i=1 to N) to the part score data items $P_i$ (i=1 to N) will be the full score data S by referring to the full score data S which is the universal set data and the part score data items $P_i$ (i=1 to N) which are the subset data items stored in the storage unit 10. The position converter 22 includes a function of converting position data items ns indicating time positions on the full score supplied from the display control unit 40 into position data items $np_i$ indicating arbitrary time positions on the part scores based on the mappings $A_i$ (i=1 to N) estimated by the mapping adjuster 21, or converting position data items $np_i$ indicating time positions on the part scores supplied from the display control unit 40 into position data items ns indicating positions on the full score.

Hereinafter, the details of the mapping adjuster 21 will be described. The full score data S and the part score data items $P_i$ (i=1 to N) which are processed by the mapping adjuster 21 will first be described.

FIGS. 2A, 2B and 2C are diagrams showing the respective examples of the full score S and the part score data items $P_1$ and $P_2$ which are processed by the mapping adjuster 21. In these drawings, the respective notes indicated by the full score data or the part score data items are respectively mappingped onto a coordinate plane that contains a time axis (n axis) and a length axis (p axis). As shown in FIG. 2A, in this example, the full score data S includes data of a part 1 and data of a part 2.

Ideally, the data of the part 1 of the full score data S corresponds to the part score data $P_1$ shown in FIG. 2B, and the data of the part 2 of the full score data S corresponds to the part score data $P_2$ shown in FIG. 2C. However, in the present embodiment, the full score data and the part score data items are based on the following premises.

Premise 1: In the full score data and the part score data items, there is a possibility that errors or omissions will occur in length information. Accordingly, in the full score data and the part score data items, there is a possibility that errors will occur in the generation time of the note (sounding start time).

In the part score data $P_1$ shown in FIG. 2B, an error is estimated that the lengths of two notes which are the fourth from the left will be less than those of the full score data S shown in FIG. 2A. For this reason, the generation times of the subsequent notes of the part 1 deviate between the full score data S and the part score data $P_1$. In the part score data $P_2$ shown in FIG. 2C, an error estimation in which the length of an initial note will be greater than that of the full score data S shown in FIG. 2A is performed. For this reason, the generation times of the subsequent notes of the part 2 deviate between the full score data S and the part score data $P_2$.

Premise 2: In the full score data and the part score data items, there is a possibility that an error will occur in pitch information of the note.

Premise 3: The full score data does not include information indicating separation between the parts. For example, in FIG. 2A, a broken line that separates the part 1 from the part 2 is depicted, but the full score data does not include information corresponding to this broken line. Accordingly, it is not able to separate data items of the respective parts from the full score data and extract the separated data.

Here, if it is possible to separate data of an arbitrary part i from the full score data and read the separated data, it is possible to easily estimate the mapping $A_i$ which correlates the part score data $P_i$ of the part i with the data extracted from the full score data S by means of a tool such as dynamic time warping (DTW).

FIG. 3 is a diagram showing an example of the processing content of the DTW. In the DTW, when pitches p of the part i indicated by the full score data S at the respective times ns and pitches p of the part i indicated by the part score data $P_i$ at the respective times np are given, the mappings $A_i$ which correlate the respective times ns on the time axis at which the full score data S exists with the respective times np on the time axis at which the part score data $P_i$ exists are generated, as shown in the drawing.

If it is possible to separate the data items of the respective parts i from the full score data S and read the separated data items, and it is possible to estimate the mappings $A_i$ by using such DTW. However, in the present embodiment, the full score data S does not include information that separates the respective parts. Thus, the mapping adjuster 21 of the present embodiment estimates the mappings $A_i$ (i=1 to N) from the full score data S and the part score data items $P_i$ (i=1 to N) as follows.

Figure 4:
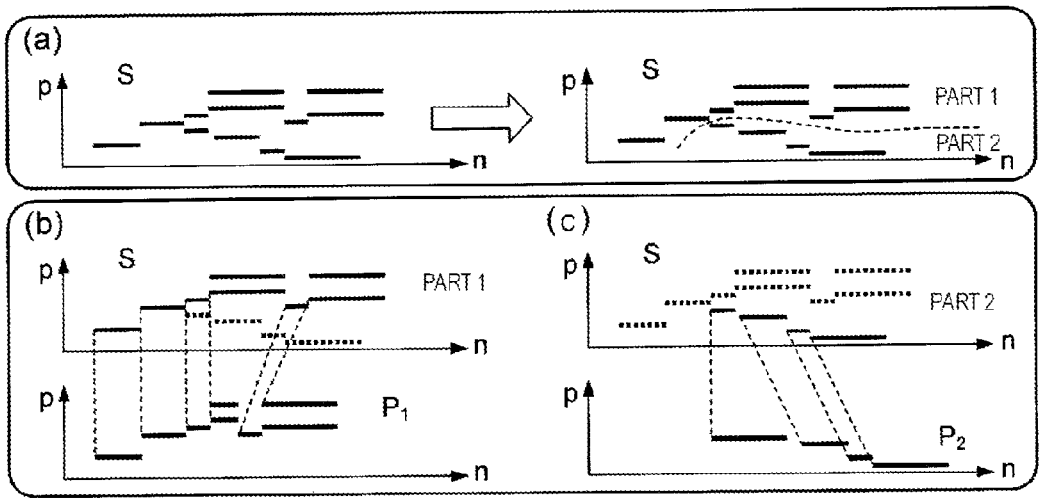
FIG. 4 is a diagram showing an operational example of the present embodiment.

The processing of the mapping adjuster 21 in the present invention includes two steps, that is, a first step of selecting codomain data items of N parts of which the union of codomain data items is the full score data S from the full score data S, as shown in (a) of FIG. 4, and a second step of estimating the mappings $A_i$ (i=1 to N) having the maximum probability that the data items $A_i(P_i)$ (i=1 to N) obtained by applying the mappings $A_i$ (i=1 to N) to the part score data items $P_i$ (i=1 to N) as domains will be the codomain data items of the N parts, as shown in (b) of FIG. 4.

It is necessary to simultaneously perform the first and second steps. The reason is that it is necessary to appropriately perform the selection in the first step in order to increase the probability that the data items $A_i(P_i)$ (i=1 to N) obtained by applying the mappings $A_i$ (i=1 to N) to the part score data items $P_i$ (i=1 to N) will be the codomain data items of the N parts in the second step, whereas it is possible to determine whether or not the selection of the codomain data items of the N parts in the first step are appropriately performed by using only the probability obtained in the second step in the first step since the full score data does not include the information regarding the separation of the parts.

Figure 5:
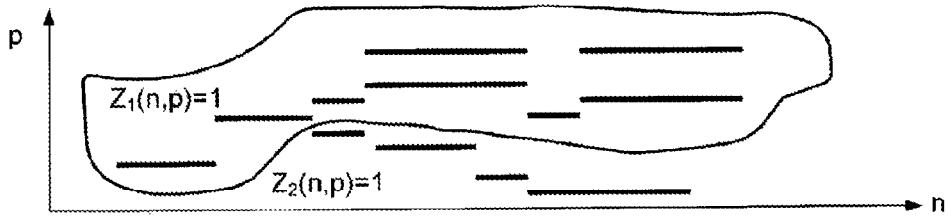
FIG. 5 is a diagram for describing a mask used in the present embodiment.

Here, in the present embodiment, it is assumed that masks $Z_i(n, p)$ are given for the respective parts i. As shown in FIG. 5, the masks $Z_i(n, p)$ are masks in which $Z_i(n, p)=1$ for grids (n, p) occupied by the codomain data items of the parts i and $Z_i(n, p)=0$ for the other grids (n, p) in the respective grids (n, p) of an n-axis and p-axis coordinate system in which the full score data S(n, p) exists.

In the present embodiment, the full score data S(n, p) is S(n, p)=1 when there is sounding (or a note) in the grids (n, p) of the n-axis and p-axis coordinate system and is S(n, p)=0 when there is no sounding. The same is true of data items $A_i(P_i)(n, p)$ (i=1 to N) obtained by applying the mappings $A_i$ (i=1 to n) to the part score data items $P_i$ (i=1 to N).

When the masks $Z_i(n, p)$ are used, it is possible to calculate the probability p(A, P, S, Z) that the codomain data items S(n, p) of the parts i of which the values are 1 in the full score data S(n, p) will be the data items $A_i(P_i)(n, p)$ obtained by applying the mappings $A_i$ to the part score data items $P_i$ of the parts i and will be the data items $A_i(P_i)(n, p)$ of which the values are 1 by using the following expression.

[Expression 1]

$$p(A, P, S, Z) = \prod_{n,p} \prod_{i} p(S(n, p) \mid (A_i(P_i))(n, p))^{Z_i(n,p)} \quad (1)$$

In the respective grids (n, p) of the n-axis and p-axis coordinate system in which the full score data S(n, p) exists, $p(S(n, p)|(A_i(P_i)(n, p))^{Zi(n, p)}=p(S(n, p)|(A_i(P_i)(n, p))$ in Expression (1) above in the regions occupied by the codomain data items of the parts i, and $p(S(n, p)|(A_i(P_i)(n, p)^{Zi(n, p)}=1$ in the other regions. Accordingly, the right side of Expression (1) above indicates the probability that the codomain data items S(n, p) of the parts i of which the values are 1 in the full score data S(n, p) will be the data items $A_i(P_i)(n, p)$ obtained by applying the mappings $A_i$ to the part score data items $P_i$ of the parts i and will be the data items $A_i(P_i)(n, p)$ of which the values are 1.

In order to improve robustness with respect to an estimation error of the length, Expression (2) below may be used instead of Expression (1).

[Expression 2]

$$p(A, P, S, Z) = \prod_{n,p} \prod_{i} \prod_{q=} [c_q(p) p(S(n, p) \mid (A_i(P_i))(n, q))]^{U_q(p) Z_i(n,p)} \quad (2)$$

In Expression (2) above, $U_q(p)$ is a binary function indicating whether or not the pitches p in the part score data $P_i$ are confused with the pitches q in the full score data S, and $c_q(p)$ is the probability that the pitches p will be confused with the pitches q. In this case, it is preferable that the $c_q(p)$ is set to become smaller as |p−q| becomes higher or is calculated based on the characteristics of the technology of scanning musical scores.

In the present embodiment, when Expression (1) above is used as an expression for calculating the probability p(A, P, S, Z), expectation values $<Z_i(n, p)>$ of the masks $Z_i(n, p)$ are calculated using the following expression.

[Expression 3]

$$<Z_i(n,p)> \propto p(S(n,p)|(A_i(P_i))(n,p)) \quad (3)$$

That is, when the expectation values $<Z_i(n, p)>$ of the masks $Z_i(n, p)$ are used and the data items $A_i(P_i)$ obtained by applying the mappings $A_i$ to the part score data items $P_i$ is the full score data S(n, p) of the grids (n, p), a value proportional to the probability $p(S(n, p)|A_i(P_i)(n, p))$ that the full score data S(n, p) of the grid (n, p) will be 1 is calculated.

It is possible to estimate the mappings $A_i$ having the maximum probability that the data items $A_i(P_i)$ obtained by applying the mappings $A_i$ to the part score data items $P_i$ will be the codomain data items of the parts i of the full score data S from the following expression by using the expectation values $<Z_i(n, p)>$ of the masks $Z_i(n, p)$.

[Expression 4]

$$A_i = \underset{A_i'}{\arg\max} = \sum_{n,p} < Z_i(n, p) > \log p(S(n, p) \mid A_i'(P_i)(n, p)) \quad (4)$$

That is, on the premise that there are data items $A_i'(P_i)$ obtained by applying mappings $A_i'$ to the part score data items $P_i$ for the respective grids (n, p) of the n-axis and p-axis coordinate system in which the full score data S(n, p) exists, a logarithm $\log p(S(n, p)|A_i'(P_i)(n, p))$ of the probability that the full score data S(n, p) of the grids (p, n) will be 1 is obtained, this logarithm is multiplied by the expectation values $<Z_i(n, p)>$ of the masks corresponding to the grids (n, p), the sum of all the grids (n, p) of the multiplied result is obtained, and a mapping $A_i'$ in which the sum thereof is maximized is used as the mapping $A_i$.

Here, when it is assumed that $\log p(S|X) \propto SX$, it is possible to transform Expression (4) above into the following expression.

[Expression 5]

$$A_i = \underset{A_i'}{\arg\max} = \sum_{n,p} [ < Z_i(n, p) > S(n, p)](A_i'(P_i))(n, p) \quad (5)$$

Thus, in the present embodiment, the arithmetic operation represented by Expression (5) is performed instead of the arithmetic operation represented by Expression (4). That is, in the present embodiment, in the n-axis and p-axis coordinate system in which the full score data S(n, p) exists, the sum of the expectation values $<Z_i(n, p)>$ of the masks for the grids (n, p) in which the data items $A_i'(P_i)(n, p)$ obtained by applying the mappings $A_i'$ to the part score data items $P_i$ are 1 are obtained, and mapping $A_i'$ in which the sum thereof is maximized are used as the mapping $A_i$.

Figure 6:
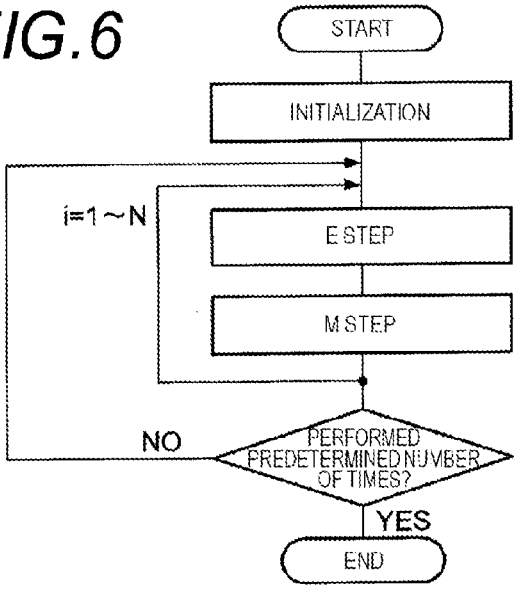
FIG. 6 is a flowchart showing an operation of the present embodiment.

In the present embodiment, the mapping adjuster 21 performs maximum-likelihood estimation of the mappings $A_i$ (i=1 to N) by means of an EM algorithm. More specifically, as shown in FIG. 6, the mapping adjuster 21 initializes various types of data items of the mappings $A_i$ (i=1 to N), and then executes a E step of performing the arithmetic operation of Expression (3) and a M step of performing the arithmetic operation of Expression (5) for each part i=1 to N. The mapping adjuster 21 repeatedly executes the E step and the M step for all the parts i (i=1 to N) a predetermined number of times.

As a result of repeatedly performing the E step and the M step for all the parts, the masks $Z_i(n, p)$ obtained in the E step and the mappings $A_i$ (i=1 to N) obtained in the M step are sequentially improved, and the probability that the codomain data items of the parts i (i=1 to N) selected from the full score data S will be the data items $A_i(P_i)(n, p)$ (i=1 to N) obtained by applying the mappings $A_i$ (i=1 to N) to the part score data items $P_i$ (i=1 to N) gradually increase.

Accordingly, the optimum mappings $A_i$ (i=1 to N) which correlate the respective score data items $P_i$ (i=1 to N) with the codomain data items of the respective parts of which the union is the full score data S are obtained. Thus, according to the present embodiment, it is possible to achieve the sharing (synchronization) of the time axis of the full score and the plurality of part scores by using the mappings $A_i$ (i=1 to N).

Second Embodiment

In the first embodiment, the masks $Z_i(n, p)$ are calculated in the E step, and the M step is executed using the masks $Z_i(n, p)$. Here, M(n, p) represented by the following expression is used instead without the masks $Z_i$.

[Expression 6]

$$M(n, p) = \arg\max_i S(n, p)(A_i(P_i))(n, p) \tag{6}$$

In Expression (6) above, in the respective grids (n, p) of the n-axis and p-axis coordinate system, the parts i in which the full score data S(n, p) is 1 and the data items $A_i(P_i)(n, p)$ obtained by applying the mappings $A_i$ to the part score data items $P_i$ are 1 are used as M(n, p).

Here, in multiple types of parts i, there may be a case where $S(n, p)(A_i(P_i))(n, p)$ is 1. In such as case, one of the parts i selected from the multiple types of parts i in which $S(n, p)(A_i(P_i))(n, p)$ is 1 is used as M(n, p).

In the M step, it is examined to calculate the mappings $A_i$ according to the following expression by using the M(n, p).

[Expression 7]

$$A_i = \underset{A_i'}{\operatorname{argmax}} = \sum_{n,p} [\delta(M(n, p), i)S(n, p)](A_i'(P_i))(n, p) \tag{7}$$

Here, δ(M(n, p), i) is 1 when M(n, p)=i, and is 0 when M(n, p)≠i. Accordingly, at the time of executing the M step corresponding to the parts i, in Expression (7) above, the mappings $A_i'$ having the maximum number of grids (n, p) among the grids (n, p) in which M(n, p)=i in which the full score data S(n, p) is 1 and the data items $A_i(P_i)(n, p)$ obtained by applying the mappings $A_i$ to the part score data items $P_i$ are 1 are used as the mappings $A_i$.

Incidentally, in Expression (6) above, S(n, p) does not depend on whether or not M(n, p) is any one of i=1 to N. Accordingly, it is possible to simplify Expression (6) as the following expression.

[Expression 8]

$$M(n, p) = \underset{i}{\operatorname{argmax}}(A_i(P_i))(n, p) \tag{8}$$

The assignment of i to M(n, p) in Expression (6) above is performed according to the following rule. That is, in the M step corresponding to the parts i, if S(n, p)=1, an index other than i is assigned to M(n, p), and if S(n, p)=0, i is assigned to M(n, p). In this case, δ(M(n, p), i)S(n, p) in Expression (7) above can be expressed as follows.

[Expression 9]

$$\delta(M(n, p), i)S(n, p) = S(n, p)\left[1 - 1\left(\bigcup_{j\neq i}(A_j(P_j))(n, p) > 0\right)\right] \tag{9}$$

In Expression (9) above, an operator 1(c) in square brackets [ ] of the right side is an operator which is 1 when a condition c is satisfied and is 0 when the condition c is not satisfied. c in parentheses of this operator 1(c) is the union of data items in which $A_j(P_j)(n, p)=1$ in the data items $A_j(P_j)(n, p)$ obtained by applying mappings $A_j$ on part score data items $P_j$ of all parts j (j≠i) other than the parts i. Accordingly, on the right side of Expression (9) above, numerical values by which S(n, p) is multiplied are 0 in the grids (n, p) in which the data items $A_j(P_j)$ obtained by applying the mappings $A_j$ to the part score data items $P_j$ of all the parts j (j≠i) other than the parts i are 1, and are 1 in the other grids (n, p).

Thus, the mapping adjuster 21 according to the present embodiment repeatedly executes the process of estimating the mappings $A_i$ (i=1 to N) a predetermined number of times by repeating an arithmetic operation represented by the following expression while changing the index i from 1 to N.

[Expression 10]

$$A_i = \underset{A_i'}{\operatorname{argmax}} \sum_{n,p}\left[S(n, p)\left[1 - 1\left(\bigcup_{j\neq i}(A_j'(P_j))(n, p) > 0\right)\right]\right]A_i'(P_i)(n, p) \tag{10}$$

In Expression (10) above, in the arithmetic operation corresponding to the parts i, among the data items $A_j(P_j)(n, p)$ obtained by applying the mappings $A_j$ to the part score data items $P_j$ of all the parts j (j≠i) other than the parts i, the union of data items of which the values are 1 is obtained. In the full score data S, the mappings $A_i'$ having the maximum number of grids (n, p) in which residual data items S(n, p) that do not belong to this union are 1 and the data items $A_i'(P_i)(n, p)$ obtained by applying the mappings $A_i'$ to the part score data items $P_i$ are 1 are estimated, and the mappings $A_i'$ are used as the mappings $A_i$. The arithmetic operation of Expression (10) corresponds to a combination of the E step and the M step of the first embodiment.

In the present embodiment, in a procedure during which the arithmetic operation of Expression (10) are repeatedly performed on all the parts i=1 to N, the mappings $A_i'$ (i=1 to N) are gradually improved, and the probability that the codomain data items of the parts i (i=1 to N) selected from the full score data S will be the data items $A_i(P_i)(n, p)$ (i=1 to N) obtained by applying the mappings $A_i$ (i=1 to N) to the part score data items $P_i$ (i=1 to N) gradually increases. Accordingly, the same effect as that in the first embodiment is also obtained in the present embodiment.

FIGS. 7A to 9B show operational examples of the present embodiment. In these drawings, a horizontal axis is an n axis (time axis), and a vertical axis is a p axis (pitch axis).

Figure 7A:
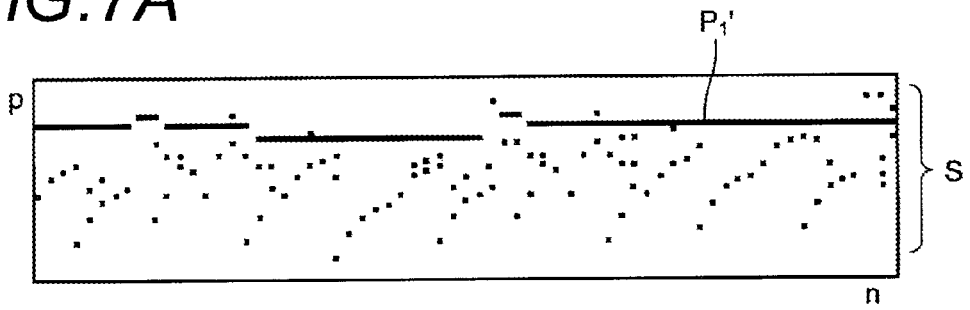
FIGS. 7A and 7B are diagrams showing an operation example of a mapping estimation apparatus which is a second embodiment of the present invention.
Figure 7B:
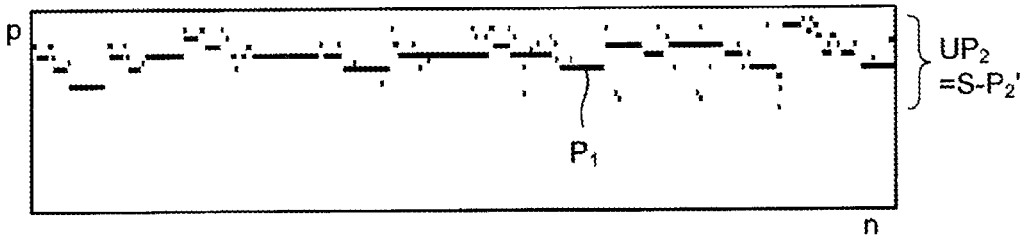

FIG. 7A shows the full score data S and data $P_1'$ of a violin part included in the full score data S. FIG. 7B shows data $UP_2$ in which data $P_2'$ of a piano part is excluded from the full score data S, and data $P_1'$ of a violin part estimated from the data $UP_2$. In this example, since the data $UP_2$ is not appropriate, the estimation of the data $P_1'$ of the violin part is erroneous.

Figure 8A:
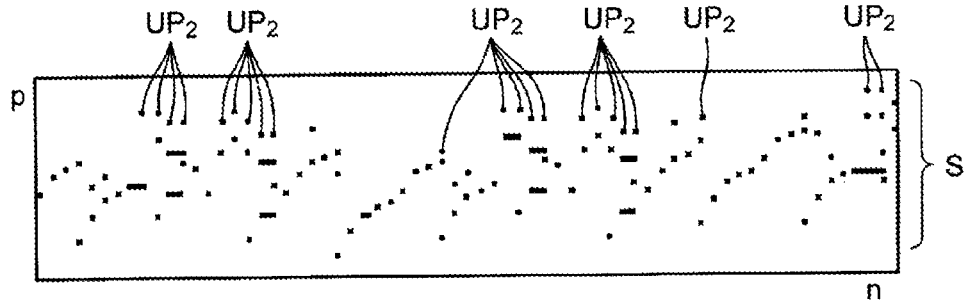
FIGS. 8A and 8B are diagrams showing another operation example of the mapping estimation apparatus.
Figure 8B:
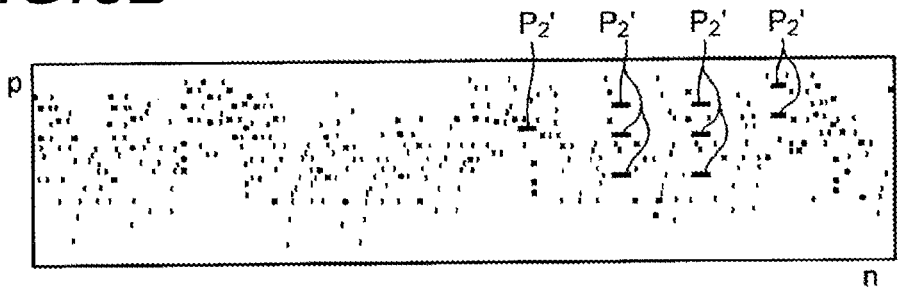

FIG. 8A shows the full score data S, and data $UP_2$ other than a piano part in the full score data S. FIG. 8B shows data $P_2'$ of a piano part estimated from data in which the data $UP_2$ is excluded from the full score data S. In this example, since the designation of the data $UP_2$ other than the piano part is appropriate, the data $P_2'$ of the piano part is approximately accurately estimated.

Figure 9A:
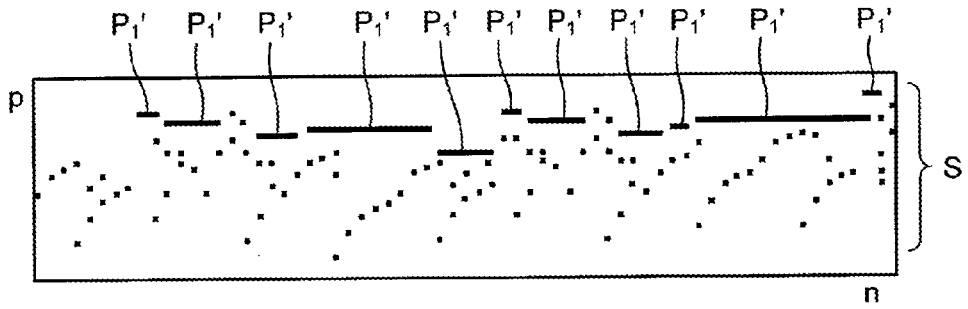
FIGS. 9A and 9B are diagrams showing still another operation example of the mapping estimation apparatus.
Figure 9B:
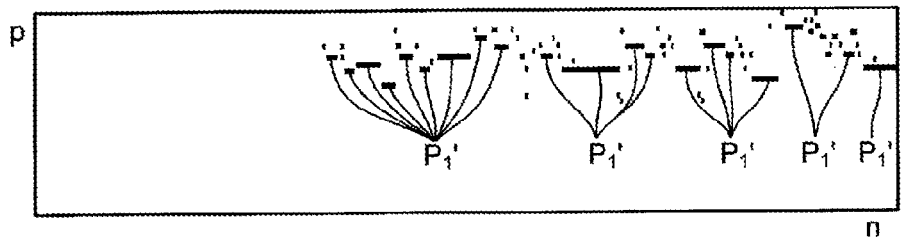

FIG. 9A shows the full score data S, and data $P_1'$ of a violin part included in the full score data S. FIG. 9B shows data $P_1'$ of a violin part estimated from residual data obtained by excluding the data $P_2'$ of the piano part estimated in FIG. 8B from the full data S. In this example, since the estimation of the data $P_2'$ of the piano part is appropriate, the data $P_1'$ of the violin part is approximately accurately estimated.

As described above, in the present embodiment, since the process of excluding the data estimated from the part score data from the full score data and the process of estimating the data within the full score data corresponding to the part score data are alternately repeated, it is possible to increase the accuracy of estimating the data within the full score data corresponding to the part score data.

Other Embodiments

As discussed above, although the first and second embodiments of the present invention have been described, various other embodiments of the present invention may be implemented.

(1) When a rehearsal signal or a bar line depicted in the musical score are more accurately read through optical recognition, information regarding the rehearsal signal or the bar line may be utilized in the calculation of the DTW. Specifically, the DTW is performed between only the regions where the region of the time axis ns of the full score data S and the region of the time axis np of the part score data $P_i$ may be correlated with each other.

Figure 10:
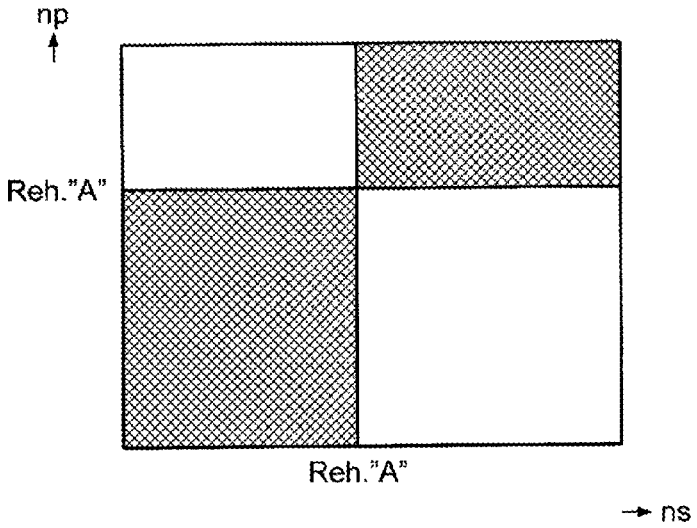
FIG. 10 is a diagram showing an operational example of a mapping estimation apparatus which is another embodiment of the present invention.

For example, in the example illustrated in FIG. 10, the full score data S and the part score data items $P_i$ include information items indicating rehearsal marks A, respectively. In this case, the rehearsal mark A of the full score data S and the rehearsal mark A of the part score data $P_i$ indicate the same timing in a music. Accordingly, the mappings $A_i$ which correlate time positions before the rehearsal mark A of the part score data $P_i$ with time positions after the rehearsal mark A of the full score data S or correlate time positions after the rehearsal mark A of the part score data $P_i$ with time positions before the rehearsal mark A of the full score data S are not appropriate. Thus, in the DTW, only the correlation within the hatched regions in FIG. 10, that is, mappings $A_i$ which correlate the time positions before the rehearsal mark A of the part score data $P_i$ with the time positions before the rehearsal mark A of the full score data S and correlate the time positions after the rehearsal mark A of the part score data $P_i$ with the time positions after the rehearsal mark A of the full score data S are estimated.

Figure 11:
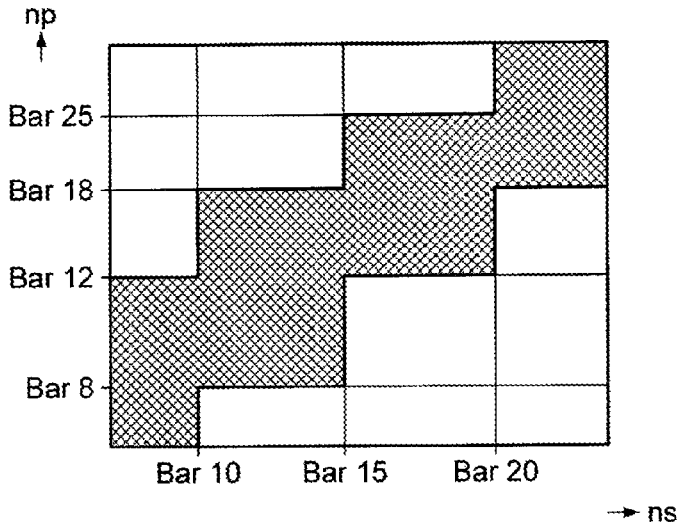
FIG. 11 is a diagram showing another operational example of the mapping estimation apparatus.

In the example illustrated in FIG. 11, the full score data S includes bar information items Bar 10, Bar 15, and Bar 20, and the part score data $P_i$ includes bar information items Bar 8, Bar 12, Bar 18, and Bar 25. Here, bar information Bar k is information indicating the position of the bar line having a bar number k. In the example illustrated in FIG. 11, in order to prevent inappropriate mappings from being calculated, only the mappings $A_i$ within the hatched regions are evaluated in the DTW. For example, only mappings $A_i$ which correlate time positions within sections having bar numbers 12 to 18 in the part score data $P_i$ with time positions within sections having bar numbers 10 to 15 in the full score data S are estimated. The same is true of other sections.

Figure 12:
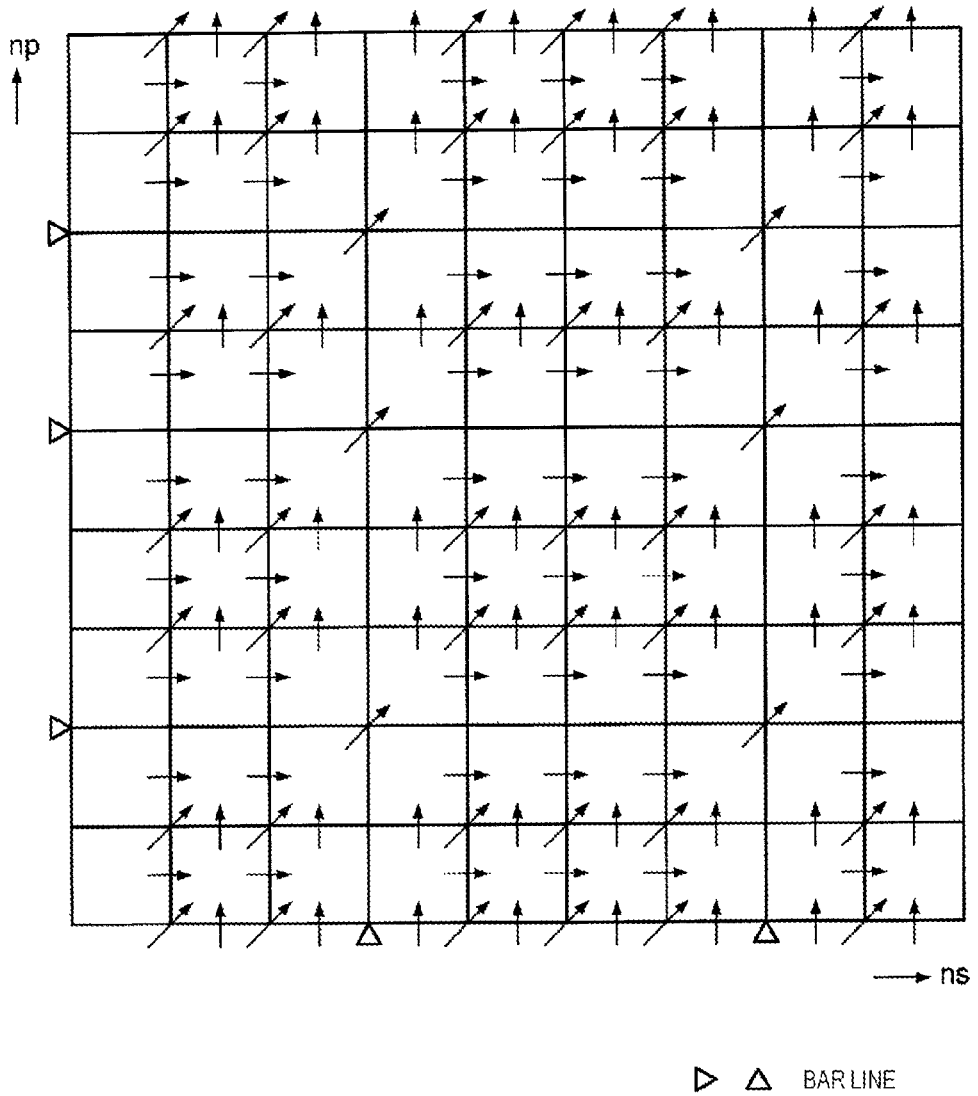
FIG. 12 is a diagram showing still another operational example of the mapping estimation apparatus.

When the full score data S and the part score data $P_i$ include the bar information items, mappings $A_i$, which correlate time positions of any one of the full score data S and the part score data $P_i$ with time positions of the other one, may be estimated according to a rule in which when the time positions of the one straddle the bar lines, the time positions of the other one may also straddle the bar lines. FIG. 12 shows an example thereof. In FIG. 12, in the mappings $A_i$ which correlate the time positions of the data in the full score data S with the time positions of the data in the part score data $P_i$, changes allowed for a pair of a time position of the domain of the mappings $A_i$ and a time position of the codomain are depicted by arrows. Mapping estimation control information indicating a range allowed for the pair of domain and codomain of such a mapping is generated based on the bar line information items within the full score data S and the part score data $P_i$, and the estimation of the mappings may be controlled based on the mapping estimation control information.

As stated above, by limiting the range allowed for the correlation between the full score data S and the part score data $P_i$, it is possible to prevent inappropriate mappings $A_i$ from being calculated, and it is possible to reduce the arithmetic operation time of the DTW.

(2) The present invention is applicable to a musical score such as a musical score in which a chord progression and a melody are described as well as a musical score written in manuscript paper. As in a band score, the present invention is also applicable to a musical score in which a drum part or a guitar part is written.

(3) The present invention is also applicable to data in which a musical performance is recorded, in addition to the musical score. For example, MIDI data of a part score obtained by playing the part score by a MIDI-compatible electronic musical instrument instead of the part score data of the above-described embodiments. Alternatively, MIDI data of the part score may be generated by playing the part score by an acoustic musical instrument, recording the played sound at this time and analyzing the recorded sound, and the generated MIDI data may be used as the part score data of the above-described embodiments. The set of MIDI data items described above, or MIDI data obtained by analyzing audio data items of all musical instruments may also be used as the full score data. A technology of converting an audio signal of the played sound into the MIDI data is disclosed in, for example, JP-A-2009-216769 and JP-A-2009-223078 as Patent Documents 2 and 3.

(4) In the above-described embodiments, although the mapping estimation apparatus using the musical score data as the universal set data and the subset data has been described, the universal set data and the subset data may be, for example, data such as image data other than musical score data.

(5) Although it has been described in the above-described embodiments that the position converter 22 performs the mutual conversion between the time position $np_i$ of the data of the part score data $P_i$ and the time position ns of the data of the full score data S, mutual conversion may be performed on time positions between different types part score data items $P_i$. First, for example, the time position $np_1$ of the data of the part data $P_1$ is converted into the time position ns of the data of the full score data S by using the mapping $A_1$. Next, the time position ns of the data of the full score data S is converted into the time position $np_2$ of the data of the part score data $P_2$ by using the mapping $A_2$. In so doing, it is possible to convert the time position $np_1$ of the data of the part score data $P_1$ into the time position $np_2$ of the data of the part score data $P_2$, and the time position can be shared by the part 1 and the part 2.

(6) In the above-described embodiments, a mode of selecting a plurality of codomain data items from the universal set data and modes of mappings applied to the plurality of subset data items may be estimated so as to have the maximum probability that data items obtained by selecting a plurality of codomain data items of which the union is the universal set data from the universal set data and applying the mappings to the plurality of subset data items as domains will be respectively the plurality of codomain data items. However, the modes of the mappings applied to the plurality of subset data items and the mode of selecting the plurality of codomain data items having the maximum probability may be estimated without repeating such adjustment. For example, the mode of the selection for obtaining the most excellent evaluation function and the modes of the mappings may be selected by examining all the modes of analyzing all the part score data items (subset data items) from the full score data (universal set data) and performing a round-robin algorithm that evaluates an evaluation function for the possibility of all the mappings in the analyzing methods.

(7) The present invention may be realized as a program that causes a computer to execute the process performed by the mapping estimation apparatus 20 according to the above-described embodiments.

(8) It has been described in the embodiments that the full score data indicates the union of the plurality of part score data items. However, the full score data may include additional information for the conductor only, which does not appear any of the part score data for the musical performers. That is, the full score data may include union of the plurality of part score data items, or may be data indicating additional data and the union of the plurality of part score data items. In general, the universal set data includes union of the plurality of subset data items, or is data indicating additional data and the union of the plurality of subset data items.

What is claimed is:

1. An apparatus, comprising:

a storage configured to store score data indicating a musical score of a musical performance, the stored score data including full score data and N part score data items stored separately from the full score data, the full score data being a union of the N part score data items that lacks information that separates the N part score data items from each other, wherein N is a natural number greater than 1, and an N-th part score data item among the N part score data items includes a first note having a length of time that differs from the length of time of the first note in the full score data and a second note having a generation time that differs from the generation time of the second note in the full score data, a display device configured to display an image of a full score indicated by the full score data; and computer-executable instructions including instructions, that when executed by a computer, cause the apparatus to:

select codomain data items of the N part score data items included in the full score data; and estimate mappings, which correlate time positions of the data in the full score data with time positions of the data in part score data items among the N part score data items, having a maximum probability that data items, obtained by applying the mappings to the N part score data items as domains, will be codomain data items of N parts, thereby identifying the N part score data items in the full score data such that when the second note in the full score data is indicated in a state that the image of the full score is being displayed by the display device, the apparatus is caused to transmit, to an external apparatus, information indicating the second note of the N-th part score data item corresponding to the second note in the full score data.

2. The apparatus of claim 1, wherein the computer-executable instructions include instructions, that when executed by the computer, cause the apparatus to estimate the mappings by using the following expressions (3) and (5):

$$<Z_i(n,p)>\propto p(S(n,p)|(A_i(P_i))(n,p)) \quad (3)$$

$$\langle Z_i(n,\ p)\rangle \propto p(S(n,\ p)\ |\ (A_i(P_i))(n,\ p)) \quad (3)$$

$$A_i = \underset{A_i'}{\operatorname{argmax}} \sum_{n,p} [\ < Z_i(n,\ p) > S(n,\ p)](A_i'(P_i))(n,\ p) \quad (5)$$

wherein Z(n,p) are masks for grids (n, p) of an n-axis and p-axis coordinate system in which the full score data S (n, p) exists, A is the mappings from the full score data, P is the part score data items, and i is an index having a value from 1 to N.

3. The apparatus of claim 2, wherein the computer-executable instructions include instructions, that when executed by the computer, cause the apparatus to repeatedly execute expressions 3 and 5 for each of the N part score data items a predetermined number of times.

4. The apparatus of claim 1, wherein the computer-executable instructions include instructions, that when executed by the computer, cause the apparatus to estimate the mappings by using the following expression (10):

$$A_i = \underset{A_i'}{\operatorname{argmax}} \sum_{n,p} \left[ S(n,\ p) \left[ 1 - 1\left( \bigcup_{j \neq i} (A_j'(P_j))(n,\ p) > 0 \right) \right] \right] A_i'(P_i)(n,\ p) \quad (10)$$

wherein (n, p) represents grids (n, p) of an n-axis and p-axis coordinate system in which the full score data S (n, p) exists, A is the mappings from the full score data, P is the part score data items, i is an index having a value from 1 to N, and j is an index having a value from 1 to N where j≠i.

* * * * *